US006950066B2

(12) United States Patent
Hendler et al.

(10) Patent No.: US 6,950,066 B2
(45) Date of Patent: Sep. 27, 2005

(54) APPARATUS AND METHOD FOR FORMING A MONOLITHIC SURFACE-MOUNTABLE ANTENNA

(75) Inventors: Jason M. Hendler, Indian Harbour Beach, FL (US); Jay A. Kralovec, Melbourne, FL (US); Mark T. Montgomery, Melbourne Beach, FL (US); Frank M. Caimi, Vero Beach, FL (US)

(73) Assignee: SkyCross, Inc., Melbourne, FL (US)

( * ) Notice: Subject to any disclaimer, the term of this patent is extended or adjusted under 35 U.S.C. 154(b) by 17 days.

(21) Appl. No.: 10/645,862

(22) Filed: Aug. 21, 2003

(65) Prior Publication Data

US 2004/0080465 A1 Apr. 29, 2004

Related U.S. Application Data

(60) Provisional application No. 60/405,039, filed on Aug. 22, 2002.

(51) Int. Cl.[7] ..... H01Q 1/38
(52) U.S. Cl. ..... 343/700 MS; 343/795
(58) Field of Search ..... 343/700 MS, 795, 343/853

(56) References Cited

U.S. PATENT DOCUMENTS

| | | | | |
|---|---|---|---|---|
| 3,967,276 A | | 6/1976 | Goubau | 343/752 |
| 4,431,998 A | * | 2/1984 | Finken | 343/797 |
| 4,847,625 A | | 7/1989 | Dietrich et al. | 343/700 MS |
| 5,003,318 A | | 3/1991 | Berneking et al. | |
| 5,121,127 A | * | 6/1992 | Toriyama | 343/700 MS |
| 5,293,176 A | | 3/1994 | Elliot | 343/797 |
| 5,880,695 A | | 3/1999 | Brown et al. | 343/700 MS |
| 5,926,137 A | | 7/1999 | Nealy | 343/700 MS |
| 6,023,244 A | | 2/2000 | Snygg et al. | 343/700 MS |
| 6,057,802 A | | 5/2000 | Nealy et al. | 343/700 MS |
| 6,232,923 B1 | | 5/2001 | Guinn et al. | 343/700 MS |
| 6,259,369 B1 | | 7/2001 | Monico | 340/572.8 |
| 6,300,906 B1 | | 10/2001 | Rawnick et al. | 343/700 MS |
| 6,359,599 B2 | | 3/2002 | Apostolos | 343/895 |
| 6,373,446 B2 | | 4/2002 | Apostolos | 343/797 |
| 6,480,158 B2 | | 11/2002 | Apostolos | 343/700 MS |
| 6,556,173 B1 | * | 4/2003 | Moustakas et al. | 343/725 |
| 6,639,558 B2 | * | 10/2003 | Kellerman et al. | 343/700 MS |

FOREIGN PATENT DOCUMENTS

DE 100 35 820 A1 1/2002

* cited by examiner

*Primary Examiner*—Shih-Chao Chen
(74) *Attorney, Agent, or Firm*—John L. DeAngelis, Jr.; Beusse Brownlee Wolter Mora & Maire, P.A.

(57) ABSTRACT

An monolithic surface mountable antenna. The antenna comprises a ground plane, two dielectric layers separated by a conductive intermediate layer and a plurality of conductive regions on a top surface. Ground vias pass through the dielectric layers and connect one or more of the conductive regions to the ground plane. At least one signal via is connected to one of the plurality of conductive regions.

29 Claims, 5 Drawing Sheets

APPARATUS AND METHOD FOR FORMING A MONOLITHIC SURFACE-MOUNTABLE ANTENNA

This application claims the benefit of the provisional patent application, entitled Apparatus and Method for Forming a Monolithic Surface-Mountable Antenna filed on Aug. 22, 2002 and assigned application Ser. No. 60/405,039.

FIELD OF THE INVENTION

The present invention is directed generally to an antenna for transmitting and receiving electromagnetic signals, and more specifically to a monolithic surface mountable antenna.

BACKGROUND OF THE INVENTION

It is generally known that antenna performance is dependent on the size, shape, and the material composition of constituent antenna elements, as well as the relationship between the wavelength of the received/transmitted signal and certain antenna physical parameters (that is, length for a linear antenna and diameter for a loop antenna). These relationships and physical parameters determine several antenna performance characteristics, including: input impedance, gain, directivity, signal polarization and radiation pattern. Generally, for an operable antenna, a minimum physical antenna dimension (or the electrically effective minimum dimension) must be on the order of a quarter wavelength (or a multiple thereof) of the operating frequency to limit the energy dissipated in resistive losses and maximize the energy transmitted. Quarter and half wavelength antennas are the most commonly used.

The burgeoning growth of wireless communications devices and systems has created a need for physically smaller, less obtrusive and more efficient antennas that are capable of wide bandwidth operation, multiple frequency band operation and/or operation in multiple modes (e.g., selectable signal polarizations and selectable radiation patterns). The smaller packaging envelopes of current handheld communications devices do not provide sufficient space for the conventional quarter and half wavelength antennas. Thus physically smaller antennas operating in the frequency bands of interest and providing the other desirable antenna operating properties (input impedance, radiation pattern, signal polarizations, etc.) are especially sought after.

Also as is known to those skilled in the art, there is a direct relationship between antenna gain and antenna physical size. Increased gain requires a physically larger antenna, while users continue to demand physically smaller antennas.

U.S. Pat. No. 3,967,276 describes an antenna structure (the so called "Goubau" antenna) comprising four elongated conductors 1, 2, 3 and 4 (see FIG. 1) having dimensions and spacing that are small compared to a wavelength at the applied signal frequency. The conductors are oriented perpendicular to a ground plane 13 with an upper end of each conductor terminated in a conductive plate, identified in FIG. 1 by reference characters 5, 6, 7 and 8. The plates 6, 7 and 8 are oriented parallel to and electrically connected to the ground plane 13 via the conductors 2, 3 and 4. The plate 5 is connected to a signal source (in the transmitting mode) via a conductor 1. In the receiving mode a received signal is supplied to receiving circuitry (not shown), operative with the antenna, via the conductor 1. The plates 5, 6, 7 and 8 are interconnected by inductive elements 9, 10, 11 and 12. The plates 1, 2, 3 and 4 and the inductive elements 9, 10, 11 and 12 can be dimensioned and spaced such that the effective electrical length of the antenna is four times the physical height. For example, if the physical height is 2.67 inches and the wavelength is 60 cm (a frequency of 500 MHz), the effective electrical length is 10.7 cm and the radiation resistance is 50 ohms. Thus the antenna will be balanced to the conventional 50 ohm coaxial cable transmission line. Generally, the plates of such antennas are constructed from sheet metal material, with the elongated conductors comprising conductive wire. These embodiments are relatively expensive to fabricate and clearly are not suitable for use with handheld communications devices.

BRIEF SUMMARY OF THE INVENTION

An antenna comprises in stacked relation, a ground plane, a dielectric layer and a plurality of conductive regions. An intermediate layer comprising a conductor segment is disposed between the ground plane and the plurality of conductive regions. A conductive ground via is connected between at least one of the plurality of conductive regions and the ground plane. A conductive signal via is connected to one of the plurality of conductive regions. The ground and the signal vias are electrically connected to the conductor segment.

BRIEF DESCRIPTION OF THE DRAWINGS

The features of the antenna constructed according to the teachings of the present invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

FIG. 12 illustrates an embodiment of an antenna constructed according to the teachings of the present invention comprising a ground plane 150 to which are electrically connected conductive vias 30, 31 and 152, which are further connected to conductive regions 28A, 28C and 28D, respectively. The signal via 32 is connected between the conductive region 28A and a signal feed (neither illustrated in FIG. 12).

FIG. 13 illustrates an embodiment of the present invention wherein a ground plane 160 extends beyond side surfaces of the stacked structure comprising the dielectric layer 22, the conductive intermediate layer 24 and the dielectric layer 26 (see FIG. 2).

DETAILED DESCRIPTION OF THE INVENTION

Figure 1:
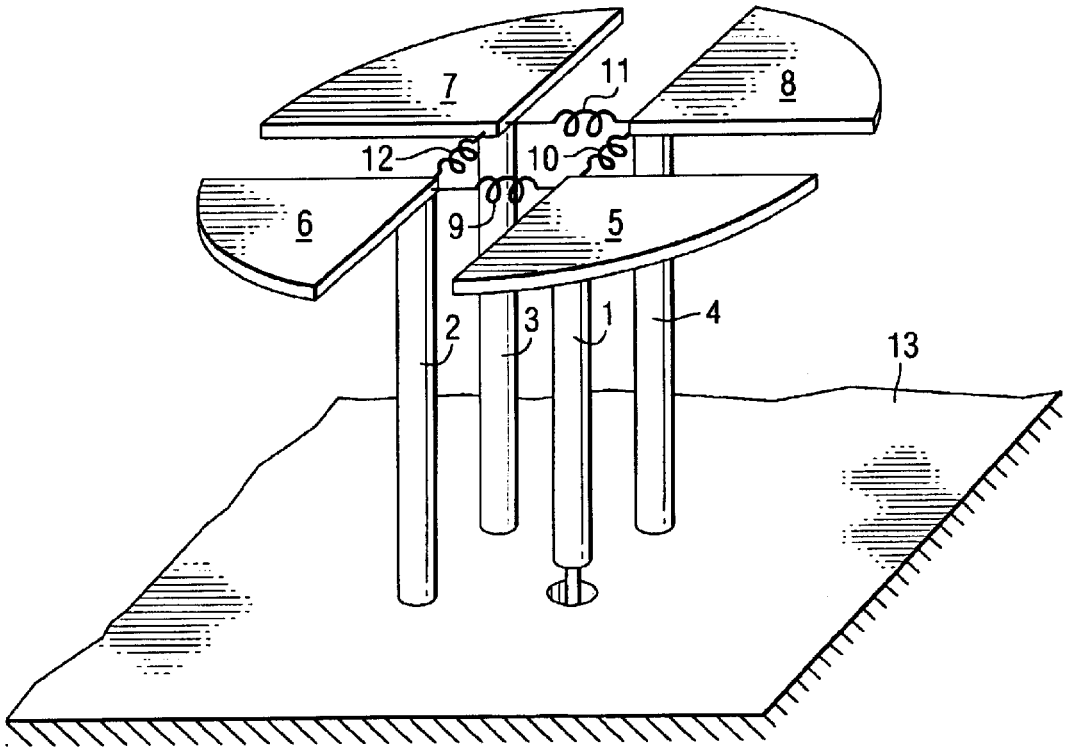
FIG. 1 PRIOR ART
FIG. 1 illustrates a prior art Goubau antenna.

Before describing in detail the particular antenna and method for forming the antenna in accordance with the present invention, it should be observed that the present invention resides primarily in a novel and non-obvious combination of elements and method steps. Accordingly, the elements have been represented by conventional elements in the drawings, showing only those specific details that are pertinent to the present invention, so as not to obscure the disclosure with structural details that will be readily apparent to those skilled in the art having the benefit of the description herein.

The present invention implements the so called "Goubau" antenna described above in a printed circuit board embodiment, resulting in a low cost, monolithic, surface mountable, antenna conveniently mountable on various substrates that carry transmitting and receiving devices operative with the antenna. For example, an antenna constructed according to the teachings of the present invention can be mounted on a laptop computer PCMCIA card that provides the laptop computer with wireless communications capabilities.

Figure 2:
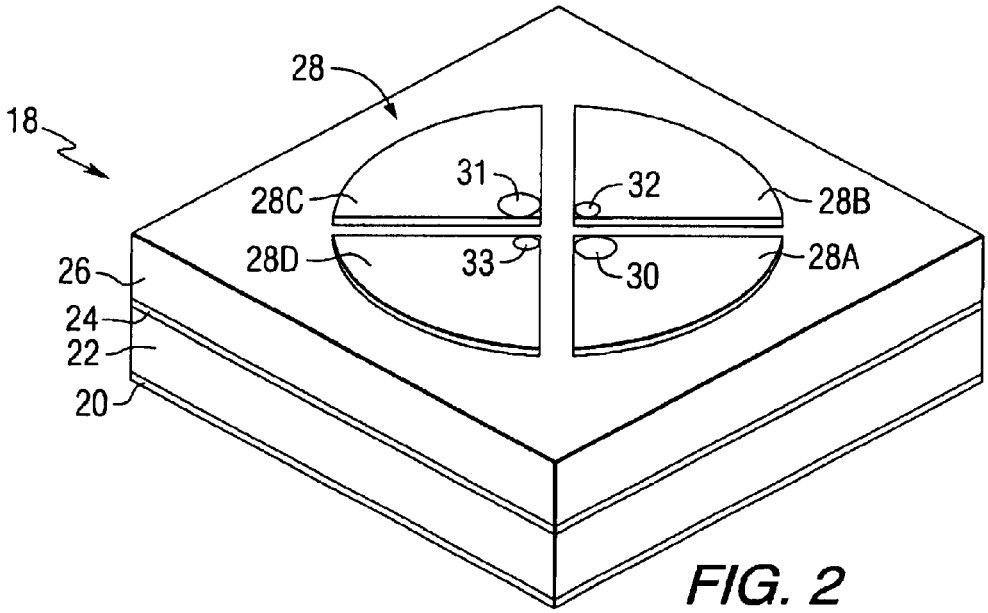
FIG. 2 illustrates an antenna constructed according to the teachings of the present invention.

FIG. 2 is a perspective view of an antenna 18 constructed according to the teachings of the present invention. The antenna 18 comprises in stacked relation a ground plane 20, a dielectric layer 22, a conductive intermediate layer 24, a dielectric layer 26 and a top layer 28. The top layer 28 comprises a plurality of spaced apart conductive regions or sectors 28A through 28D. Two opposing regions 28A and 28C are each electrically connected to the ground plane 20 by way of a conductive ground via 30 and 31, respectively. Two opposing regions 28B and 28D are each connected to a conductive signal via 32 and 33, respectively. The signal vias 32 and 33 are responsive to a signal feed (not shown) for providing a signal to be transmitted when the antenna 18 is operative in a transmitting mode, and for providing a received signal when the antenna 18 is operative in the receiving mode. In the transmitting mode, the vias 30–33 are the primary radiating elements. In the receiving mode, they are the primary receiving elements. The conductive ground vias 30 and 31 and the conductive signal vias 32 and 33 are interconnected in the conductive intermediate layer 24, as will be described further below.

The conductive regions 28A–28D provide top loading for the antenna 18 to reduce the physical antenna height The use of top loading and conductive ground vias 30 and 31 allows the antenna 18 to match to a 50 ohms impedance with an antenna height (or length) less than the typical quarter-wavelength monopole antenna. All of the various antenna embodiments described herein provide these beneficial operating characteristics. Although the conductive regions 28A–28D are illustrated as sectors derived from a circle, this geometry is merely exemplary. The regions 28A–28D can be implemented with other closed curves, including, closed plane figures having a boundary selected from among straight lines and curves. The illustrated circular sectors each comprise two intersecting line segments with an arc connecting the non-intersecting endpoints of the line segments. An apex or tip region is defined at the intersection of the two line segments.

The ground plane 20, the conductive intermediate layer 24 and the top layer 28 are formed from conductive material layers disposed on dielectric substrates, such as copper-clad printed circuit board material (also referred to as FR4). The conductive material layers are patterned, masked and etched to form the desired features of the ground plane 20, the conductive intermediate layer 24 and the top layer 28. Thus the antenna 18 can be fabricated by employing conventional single and multilayer printed circuit board fabrication techniques.

For example, a first double-clad dielectric substrate is processed to form the features of the ground plane 20 and the conductive intermediate layer 24. A second single-clad dielectric substrate is processed to form the features of the top layer 28. A thin adhesive bonding layer is applied to one or both of the mating surfaces of the two dielectric substrates (that is, the conductive intermediate layer 24 of the first dielectric substrate and a bottom surface of the second dielectric substrate). The two dielectric substrates are brought into contact and pressure is applied to form the antenna 18.

Figure 3:
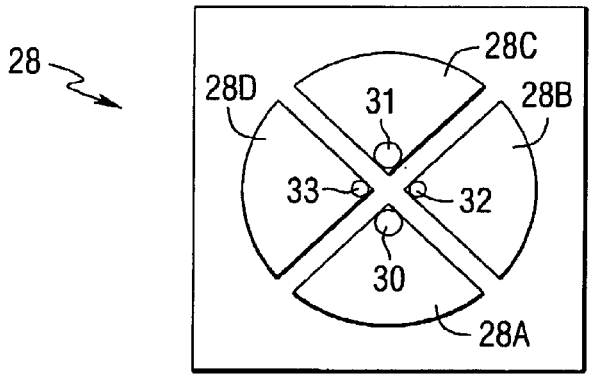
FIG. 3 illustrates a top view of a conductive layer of the antenna of FIG. 2.

FIG. 3 is a top view of the top layer 28. As illustrated in FIG. 3 the signal vias 32 and 33 are slightly smaller in diameter than the ground vias 30 and 31, although this is not necessarily required for operation of the antenna 18. The size and location of the signal vias and the ground vias can vary in different embodiments of the present invention to optimize impedance matching of the antenna 18 to the transmitting/receiving circuitry. In addition to the configuration illustrated in FIG. 3, there may be other combinations of via location and size, for both the signal vias and the ground vias that will produce an acceptable value of antenna impedance.

Further, although four conductive regions 28A–28D are illustrated, other embodiments can have more or fewer conductive regions and corresponding desirable antenna operating characteristics. For example, the antenna radiation resistance is a direct function of the square of the number of regions. As the radiation resistance increases relative to the antenna reactance (where the reactance represents the energy stored in the antenna and not radiated), the Q factor of the antenna declines and the operational bandwidth increases. If this is a desirable antenna characteristic, the number of conductive regions can be increased to achieve the desired radiation resistance.

Figure 4:
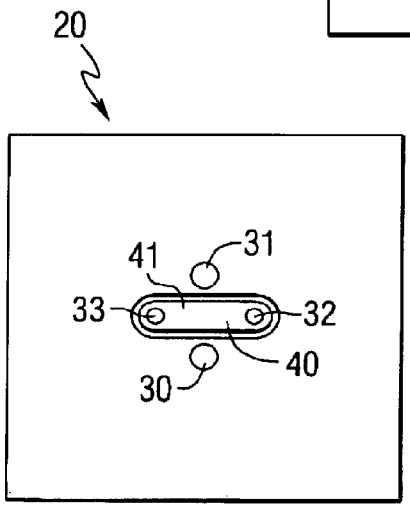
FIG. 4 is a bottom view of the antenna of FIG. 2.

FIG. 4 is a bottom view of the antenna 18, illustrating the ground plane 20, the ground vias 30 and 31 and the signal vias 32 and 33. As can be seen, there is a region 40, surrounding the signal vias 32 and 33, from which conductive material forming the ground plane 20 has been removed. Within the region 40 a conductive pad 41 interconnects the signal vias 32 and 33 and functions as a signal feed. Thus in the transmitting mode a signal is supplied to the antenna 18 between the ground plane 20 and the signal vias 32 and 33 (which are electrically identical to the conductive pad 41). In the receiving mode the received signal is supplied to receiving circuitry (not shown) at these same two signal vias 32 and 33.

Figure 5:
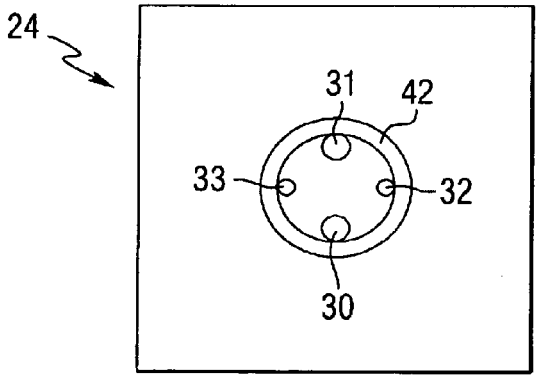
FIG. 5 is a top view of a conductive mid-layer of the antenna of FIG. 2.

FIG. 5 is a top view of the conductive intermediate layer 24, including a conductive trace 42 (in this embodiment the trace 42 is in the shape of a ring) providing inductive coupling between the ground vias 30 and 31 and the signal vias 32 and 33. Other techniques for inductively coupling the ground vias 30 and 31 and the signal vias 32 and 33 are known in the art.

In another embodiment of the antenna 18, the ground plane 20 is absent. The ground vias 30 and 31 and signal vias 32 and 33 terminate at a bottom surface of the dielectric layer 22. The ground vias 30 and 31 are adapted for electrical connection to a ground plane or ground surface formed on a printed circuit board or other substrate to which the antenna 18 is attached. Similarly, the signal vias 32 and 33 are adapted for electrical connection to signal traces or conductive features on the printed circuit board or substrate.

Figure 6:
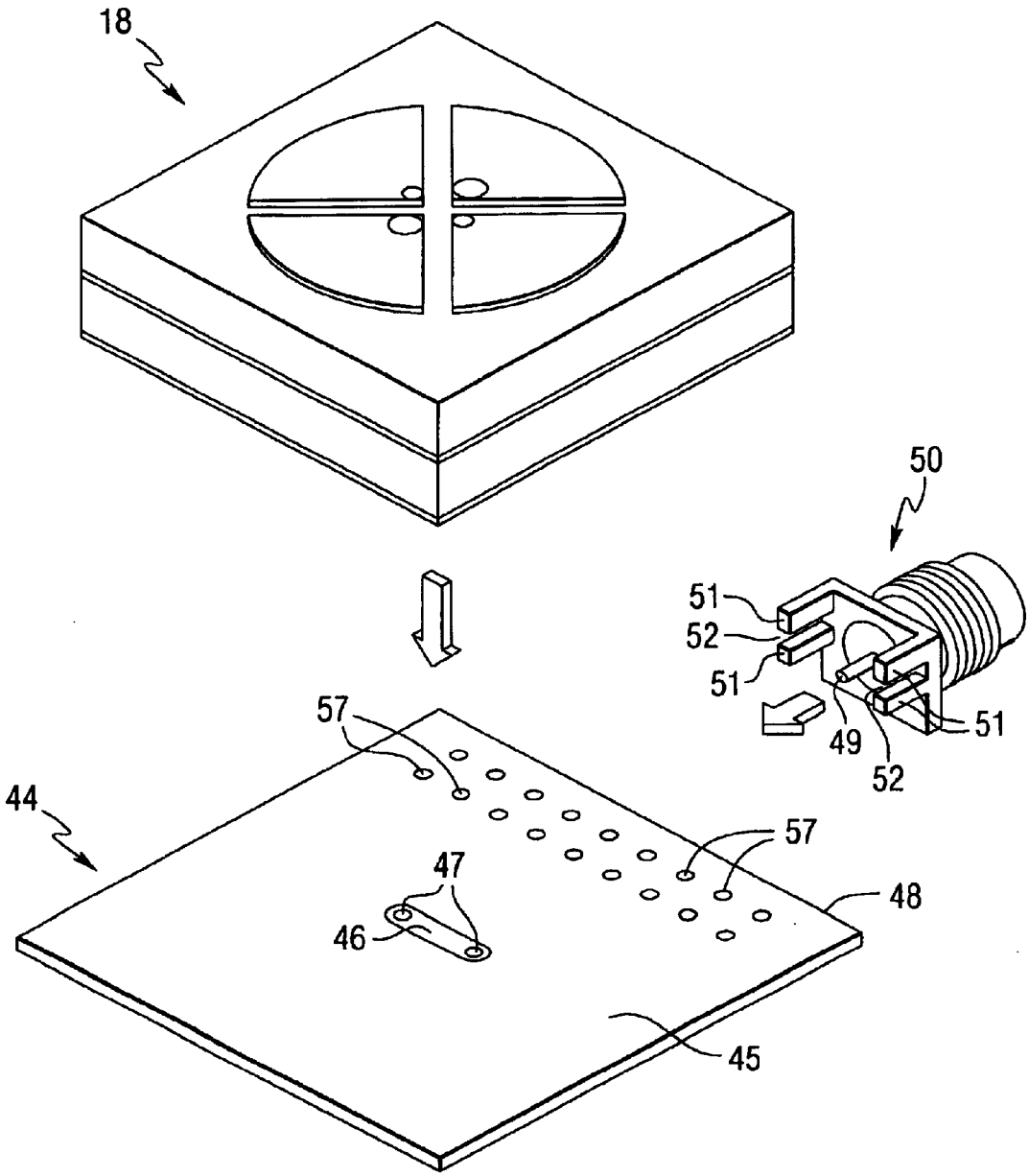
FIG. 6 is an exploded view of the antenna of FIG. 1 and a printed circuit board on which the antenna is mounted.

FIG. 6 is an exploded view of the antenna 18, a printed circuit board 44 on which the antenna 18 is mounted, and a connector 50. The antenna 18 is surface mounted on the printed circuit board 44, with the top layer 28 oriented up, using known solder reflow or other techniques for physically joining the antenna 18 to the board 44 while also ensuring that the appropriate electrical connections are effected between elements on the board 44 and the elements of the antenna 18.

The ground vias 30 and 31 are electrically joined to a ground plane 45 on the board 44 by the aforementioned solder reflow techniques. The signal vias 32 and 33 are electrically joined to an electrical trace 46, that is further connected to an electrical trace (not shown) on the underside of the printed circuit board 44 through vias 47. The underside trace terminates at an edge 48 of the printed circuit board 44 for connection to a terminal 49 of the connector 50. Thus the signal is supplied to the antenna 18 through the connector 50 when operative in the transmitting mode and a received signal is supplied to the connector 50 from the antenna 18 when operative in the receiving mode.

Each pair of fingers 51 defines a slot 52 there between for engaging the edge 48, and further for contacting a ground surface on the hidden side of the printed circuit board 44. Vias 57 connect the ground plane 45 to the ground surface on the hidden side of the printed circuit board 44.

FIG. 6 represents one mounting system for the antenna 18. Those skilled in the art recognize that other mounting systems, as determined by the design of the wireless device with which the antenna operates, can be employed with the antenna 18. Additionally, the mounting features of the antenna 18, such as the location of the signal vias 32 and 33 may require modification to accommodate the wireless device design.

Figure 7:
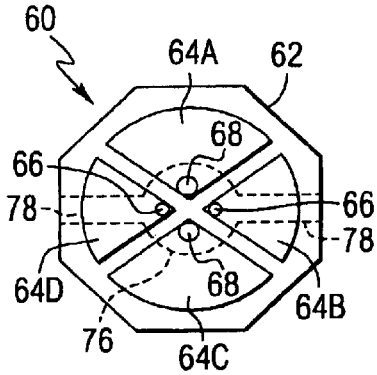
Figure 8:
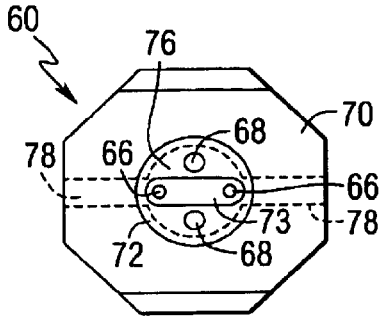
Figure 9:
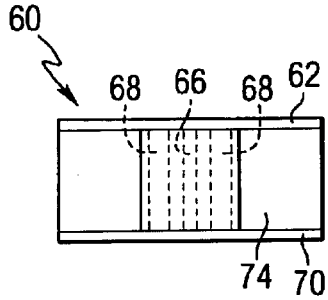

FIGS. 7, 8 and 9 illustrate another embodiment of the present invention in the form of an antenna 60. The FIG. 7 top view depicts a top layer 62 comprising four conductive segments 64A–64D, conductive signal vias 66 and conductive ground vias 68. A ground plane 70, comprising a conductive surface, is illustrated in the bottom view of FIG. 8. The conductive material has been removed within a region 72 of the ground plane 70 such that an interconnecting elongated pad 73 is formed within the region 72 to connect the two signal vias 66. A dielectric layer 74 is disposed between the ground plane 70 and the top layer 62 as shown in the side view of FIG. 9 (looking from the right side of the FIG. 7 top view). Three of the four conductive vias (the fourth being obscured) are also visible in phantom in FIG. 9.

Figure 10:
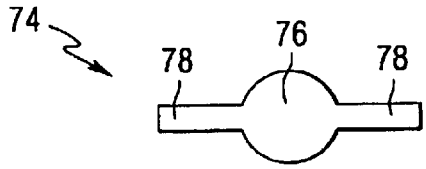
FIGS. 7–10 illustrate views of an antenna constructed according to another embodiment of the present invention.

FIG. 10 is a top view illustrating the shape of the dielectric layer 74, comprising a center circular portion 76 and two wings 78 extending radially therefrom. These elements are also shown in phantom in FIGS. 7 and 8.

The signal vias 66 and the ground vias 68 are electrically connected by a circular conductive trace, similar to the conductive trace 42 of FIG. 5, within the dielectric ring portion 76. Since the only dielectric material of the middle layer 74 comprises the ring portion 76 and the wings 78, there is considerably less dielectric material in the antenna 60 than in the antenna 18. Thus the bandwidth of the antenna 60 is greater than the bandwidth of the antenna 18. The antenna 60 constructed according to the teachings of one embodiment of the present invention exhibits a bandwidth of about 800 MHz at an operating resonant frequency of about 5 GHz.

Advantageously, fabrication of the various antenna embodiments described herein follows conventional printed circuit board fabrication techniques. For example, the conductive regions are formed for the intermediate layer 24 and a stack comprising the dielectric layers and the conductive layers is formed. Typically, the dielectric layers comprise a dielectric substrate having a conductive layer disposed thereon. Holes are drilled and plated to form the signal and the ground conductive vias. The top and bottom surfaces (that is, with respect to the various embodiments described herein, the top layer or plate and the ground plane) are patterned and etched. The solder mask material is then applied for use during the surface mounting process. For the embodiment of FIGS. 7, 8, 9 and 10, certain regions of the inner dielectric material are removed by routing, for example.

Figure 11:
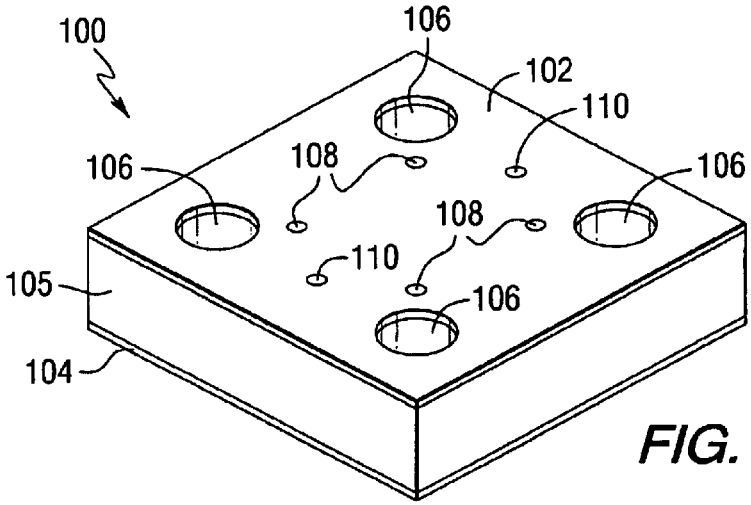
FIG. 11 is a perspective view of an antenna constructed according to yet another embodiment of the present invention.
Figure 12:
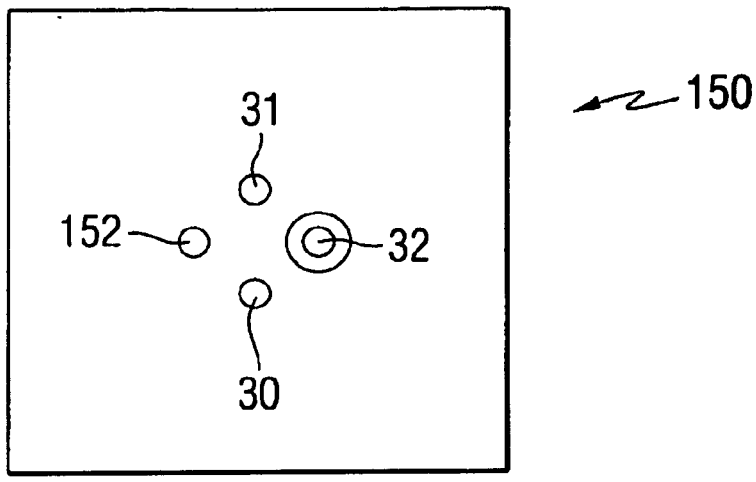
FIG. 12 is a bottom view of another embodiment of an antenna constructed according to the teachings of the present invention.
Figure 13:
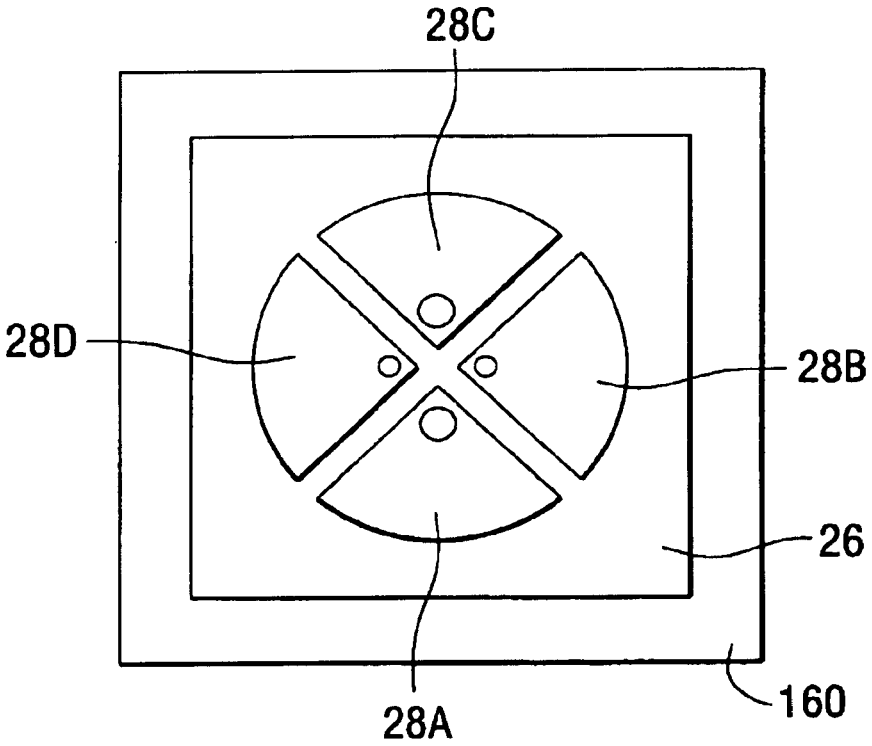
FIG. 13 is a top view of yet another embodiment of an antenna constructed according to the teachings of the present invention.

FIG. 11 illustrates a perspective view of an antenna 100 constructed according to another embodiment of the present invention, including a top plate 102 and a ground plane 104, separated by a dielectric layer 105. The dielectric loading of the antenna 100 is reduced by a plurality of holes 106 (by way of example, four holes 106 are illustrated in FIG. 10, but the illustration of four holes is not intended to suggest a limitation as to the number of holes that can be formed) extending through the top plate 102, the dielectric layer 105 and the ground plane 104. The holes 106 are not plated-through conductors. Conductive ground vias 108 extend between and interconnect the top plate 102 and the ground plane 104. Conductive signal vias 110 are electrically connected to the top plate 102, and extend to but are insulated from the ground plane 104.

The signal vias 110 are interconnected in the plane of the ground plane 104, for example using a technique similar to the interconnection scheme of FIG. 4 with respect to the antenna 18. That is, the signal vias 110 are isolated from the conductive material forming the ground plane 104 and interconnected with a separate conductive feature. The signal vias 110 can be connected to a signal carrying conductor, for example comprising a conductive trace formed on a dielectric substrate, by techniques explained above in conjunction with FIG. 6 or according to other techniques known in the art.

In the embodiment of the antenna 100 an intermediate conductive layer, such as the conductive intermediate layer 24 of FIG. 2, is absent. The interconnection between the ground vias 108 and the signal vias 110 occurs in the top plate 102.

In one exemplary embodiment the antenna 100 operates at a resonant frequency of about 5 GHz with a bandwidth of about 300 MHz.

In one embodiment, the antenna 100 is formed from two layers, each comprising a conductive sheet disposed on a dielectric substrate. The two dielectric substrates are bonded together such that the outside layers comprise the top plate 102 and the ground plane 104. The ground vias 108, the signal vias 110 and the holes 106 are formed therein as shown in FIG. 10. The top plate 102 and the ground plane 104 are patterned and etched as required.

According to another embodiment of the antenna 100, the ground plane 104 is absent. Thus the ground vias 108 and signal vias 110 terminate at a bottom surface of the dielectric layer 105. The ground vias 108 are adapted for electrical connection to a ground plane or ground surface formed on a printed circuit board or other substrate to which the antenna 100 is attached. Similarly, the signal vias 110 are adapted for electrical connection to signal traces or other signal carrying conductive features on the printed circuit board or substrate.

The radiation pattern of the antennas 18, 60 and 100 are substantially omnidirectional in the azimuth plane, i.e., the donut pattern, since most of the energy is radiated from the antenna edges and the ground and signal vias of each antenna. Little energy is radiated from the various conductive features on the top surface of the antennas 18, 60 and 100 and from their respective ground planes. The signal is vertically polarized.

The dimensions and shapes of the various antennas and their respective features as described herein can be modified to permit operation in desired frequency bands with desired operational bandwidths. The radiation patterns can be modified by relocating various antenna components to an asymmetrical geometry. Generally, changing the size of the various features changes only the antenna resonant frequency.

The design attributes of the various antenna embodiments described above allow their assembly onto a printed circuit board using the same pick, place and reflow solder techniques used for other printed circuit board components. Considerable manufacturing savings thus accrue in the board manufacturing process. According to certain prior art techniques, antenna elements are etched into the printed circuit board artwork and thus cannot be modified without considerable expense. Other prior art antennas requite hand soldering of connectors and cable assemblies to the printed circuit board, all of which are labor intensive manufacturing techniques. The teachings of the present invention avoid these difficulties and expenses.

Although the embodiments described above refer to four conductive vias the scope of the present invention is not so limited. Antennas within the scope of the present invention can be constructed from more or fewer vias extending upwardly from the ground plane, or extending from the bottom surface of the antenna in an embodiments where a ground plane is disposed on the substrate to which the antenna is mounted. Generally, the lower end of all but one via is connected to the ground plane, either the antenna ground plane or a ground plane on the mounting surface, with the unconnected via forming the antenna signal feed. Generally, each via is terminated in a capacitive element at an upper end (i.e., the end spaced apart from the ground plane) and inductively coupled to the other conductive vias.

Additionally, if all the antenna elements are symmetrical with respect to a central antenna axis and similarly dimensioned, the radiation pattern is substantially symmetrical. Asymmetrical and/or non-uniform features can produce other desired operating characteristics. For example, it is not required that all of the conductive regions 28A–28D have the same shape.

In still another embodiment the antenna ground plane (for example, the ground plane 20 of FIG. 2) is replaced by a structure substantially similar to the top plate 28, resulting in a dipole antenna instead of a monopole antenna above a ground plane.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope thereof. For example, different sized and shaped elements can be employed to form an antenna according to the teachings of the present invention. Therefore, it is intended that the invention not be limited to the particular embodiment disclosed as the best mode contemplated for carrying out this invention, but that the invention will include all embodiments falling within the scope of the appended claims.

What is claimed is:

1. An antenna adapted for connection to a signal feed, comprising:

in stacked relation;

a ground plane;

a dielectric layer;

a plurality of conductive regions;

an intermediate layer comprising a conductor segment and disposed between the ground plane and the plurality of conductive regions;

first ones of the plurality of conductive regions each having a conductive via connected to the ground plane;

second ones of the plurality of conductive regions each having a conductive via connected to the signal feed; and wherein the ground and the signal vias are electrically connected to the conductor segment.

2. The antenna of claim 1 wherein each one of the plurality of conductive regions comprises a closed plane figure having a boundary selected from among straight lines and curves.

3. The antenna of claim 1 wherein each one of the plurality of conductive regions comprises a sector of a circle.

4. The antenna of claim 3 wherein the sector comprises a first straight line having a first and a second endpoint and a second straight line having a third and a fourth endpoint, and wherein the first and the second straight lines are joined at the first and the third endpoints to form an apex, and wherein an arc extends between the second and the fourth endpoints.

5. The antenna of claim 1 wherein the plurality of conductive regions are disposed in a plane having a point defined therein, and wherein the plurality of conductive regions comprises a first, a second, a third and a fourth sector, and wherein the apex of each of the first, the second, the third and the fourth sectors is positioned an equal distance from the point, and wherein the arcs of each of the first, the second, the third and the fourth sectors circumscribe a circle in the plane.

6. The antenna of claim 5 further comprising a first and a second conductive ground via and a first and a second conductive signal via, wherein the first and the second ground vias and the first and the second signal vias are equally spaced about the point defined in the plane and located within one of the first, the second, the third, and the fourth sectors.

7. The antenna of claim 6 wherein the first and the second sectors are opposingly disposed about the point, and wherein the third and the fourth sectors are opposingly disposed about the point, and wherein the first and the second signal vias are disposed within the first and the second sectors respectively, and wherein the first and the second ground vias are disposed within the third and the fourth sectors.

8. The antenna of claim 1 further comprising three conductive ground vias, wherein the plurality of conductive regions comprises four conductive regions, and wherein each one of the three conductive ground vias is connected to one of the four conductive regions, and wherein the conductive signal via is connected to a fourth one of the four conductive regions.

9. The antenna of claim 1 wherein the conductor segment provides inductive coupling between the ground via and the signal via.

10. The antenna of claim 1 wherein the plurality of conductive regions provide capacitive coupling to the ground plane.

11. The antenna of claim 1 further comprising a ground terminal in electrical communication with the conductive ground via on a bottom surface of the antenna, wherein the antenna is adaptable for mounting on a substrate having a ground region, and wherein the ground terminal is adapted for connection to the ground region.

12. The antenna of claim 1 further comprising a signal feed terminal in electrical communication with the conductive signal via on a bottom surface of the antenna, wherein the antenna is adaptable for mounting on a substrate having a signal feed conductor, and wherein the signal feed terminal is adapted for connection to the signal feed conductor.

13. The antenna of claim 1 wherein a size of the dielectric layer is substantially similar to a size of the ground plane.

14. The antenna of claim 1 wherein a size of the dielectric layer is smaller than a size of the ground plane.

15. The antenna of claim 1 wherein the dielectric layer comprises a substantially circular dielectric layer, and wherein the conductor segment is disposed in the substantially circular dielectric layer.

16. The antenna of claim 15 wherein the dielectric layer further comprises a first and a second wing portion each extending radially from the substantially circular dielectric layer.

17. An antenna adapted for connection to a ground plane and to a signal feed, the antenna comprising:

in stacked relation:

a first dielectric layer;

a conductive layer comprising a conductor segment;

a second dielectric layer;

a plurality of conductive regions;

a conductive ground via connected between at least one of the plurality of conductive regions and extending downwardly to a bottom surface of the first dielectric layer for connection to the ground plane;

a conductive signal via connected to one of the plurality of conductive regions and extending downwardly to a bottom surface of the first dielectric layer for connection to the signal feed; and wherein the ground and the signal vias are electrically connected to the conductor segment.

18. An antenna comprising:

in stacked relation;

a ground plane;

a first dielectric layer;

an intermediate conductive layer comprising a conductor segment;

a second dielectric layer;

a plurality of conductive regions;

a conductive ground via connected between at least one of the plurality of conductive regions and the ground plane;

a conductive signal via connected to one of the plurality of conductive regions; and wherein the ground and the signal vias are electrically connected to the conductor segment.

19. The antenna of claim 18 wherein the conductor segment inductively couples the ground and the signal vias.

20. The antenna of claim 18 wherein the plurality of conductive regions provide capacitive loading for the antenna.

21. The antenna of claim 18 wherein each one of the plurality of conductive regions comprises a conductive region having a circular sector shape.

22. The antenna of claim 18 wherein the conductor segment comprises a conductive ring.

23. An antenna comprising:

in stacked relation;

a ground plane;

a first dielectric layer;

an intermediate conductive layer comprising a conductor segment;

a second dielectric layer;

a first, a second, a third and a fourth sector-shaped conductive region;

a first and a second conductive ground via connected between the first and the third conductive regions and the ground plane, respectively;

a first and a second conductive signal via connected to the second and the fourth conductive regions; and wherein the ground and the signal vias are electrically connected to the conductor segment.

24. The antenna of claim 23 wherein the first, the second, the third and the fourth sector-shaped conductive regions each comprise an apex region, and wherein the first and the second ground vias and the first and the second signal vias are disposed in the apex region.

25. The antenna of claim 23 wherein the ground plane comprises a conductive sheet, wherein the first and the second signal vias extend to the ground plane and are isolated from the conductive sheet.

26. The antenna of claim 25 wherein the antenna is adapted for mounting on a substrate comprising a signal feed and a ground region, and wherein the first and the second ground vias are adapted for connection to the ground region, and wherein the first and the second signal vias are adapted for connection to the signal feed.

27. An antenna adapted for mounting onto a substrate having a ground region and a signal feed, the antenna comprising;

a dielectric layer comprising opposing first and second surfaces;

a conductive plate disposed on the first surface;

at least one conductive ground via connected to the conductive plate and extending to the second surface;

at least one conductive signal via connected to the conductive plate and extending to the second surface;

the dielectric layer and the conductive plate defining apertures therein;

the ground via adapted for connection to the ground region; and the signal via adapted for connection to the signal feed.

28. A method for forming an antenna comprising:

providing a first dielectric substrate comprising first and second opposingly disposed surfaces and a first conductive layer disposed on the first surface;

forming a conductive segment in the first conductive layer;

providing a second dielectric substrate comprising third and fourth opposingly disposed surfaces and a second conductive layer disposed on the third surface;

forming a plurality of conductive regions in the second conductive layer;

bonding the first conductive layer to the fourth surface;

forming at least one conductive ground via connected to a first one of the plurality of conductive regions and extending to the second surface;

forming at least one conductive signal via connected to a second one of the plurality of conductive regions and extending to the second surface and wherein the at least one ground via and the at least one signal via are further connected to the conductive segment.

29. The method of claim 28 wherein the first dielectric substrate further comprises a third conductive layer disposed on the second surface, and wherein the step of forming at least one ground via further comprises connecting the ground via to the third conductive layer, and wherein the step of forming at least one signal via further comprises insulating the signal via from the third conductive layer.

* * * * *